United States Patent [19]

Preddey

[11] Patent Number: 4,478,061

[45] Date of Patent: Oct. 23, 1984

[54] CYLINDER LOCK

[75] Inventor: Brian F. Preddey, Miranda, Australia

[73] Assignee: Taboola Pty. Limited, New South Wales, Australia

[21] Appl. No.: 362,797

[22] Filed: Mar. 29, 1982

[30] Foreign Application Priority Data

Mar. 30, 1981 [AU] Australia ..... PE8207
Jul. 8, 1981 [AU] Australia ..... PE9648

[51] Int. Cl.[3] ..... E05B 27/06

[52] U.S. Cl. ..... 70/358; 70/364 A; 70/409; 70/378

[58] Field of Search ..... 70/358, 409, 411, 364 A, 70/362, 453, 385, 382, 378

[56] References Cited

U.S. PATENT DOCUMENTS

| | | | |
|---|---|---|---|
| 570,032 | 10/1896 | Luebbers . | |
| 1,823,547 | 9/1931 | Kaefer . | |
| 2,620,649 | 12/1952 | Bernardo | 70/358 |
| 3,736,780 | 6/1973 | Singer | 70/453 |
| 3,754,422 | 8/1973 | Stackhouse . | |
| 3,968,668 | 7/1976 | Epstein . | |
| 4,099,398 | 7/1978 | Lipschutz . | |

FOREIGN PATENT DOCUMENTS

| | | | |
|---|---|---|---|
| 337838 | 6/1921 | Fed. Rep. of Germany . | |
| 1428504 | 3/1969 | Fed. Rep. of Germany . | |
| 2113008 | 10/1971 | Fed. Rep. of Germany | 70/358 |
| 2924990 | 7/1980 | Fed. Rep. of Germany . | |
| 2124008 | 9/1972 | France . | |
| 544868 | 1/1974 | Switzerland . | |
| 1223142 | 2/1971 | United Kingdom . | |
| 1517704 | 7/1978 | United Kingdom . | |
| 2055948 | 3/1981 | United Kingdom . | |

*Primary Examiner*—Robert L. Wolfe
*Attorney, Agent, or Firm*—Ladas & Parry

[57] ABSTRACT

A cylinder lock having a generally cylindrical barrel with a barrel body within which are slidably located a plurality of locking pins which intersect the keyway in the cylinder lock to thereby engage a key located in the keyway. The locking pins are arranged in two sets which extend generally longitudinally of the body with the locking pins secured within the body to prevent rotation about the axis of movement of the pins.

9 Claims, 16 Drawing Figures

FIG. 3
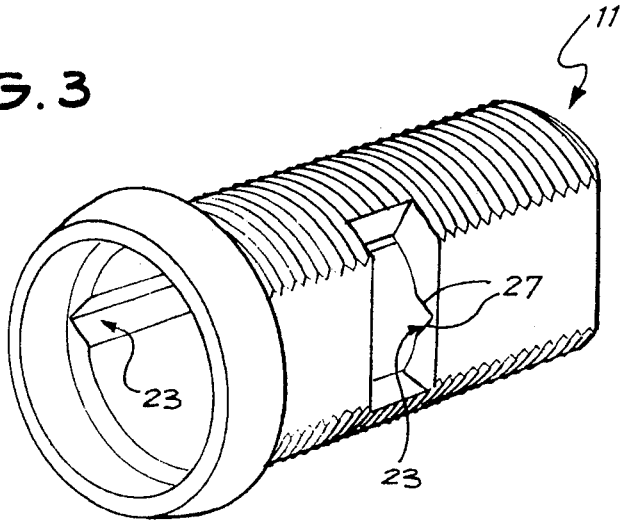
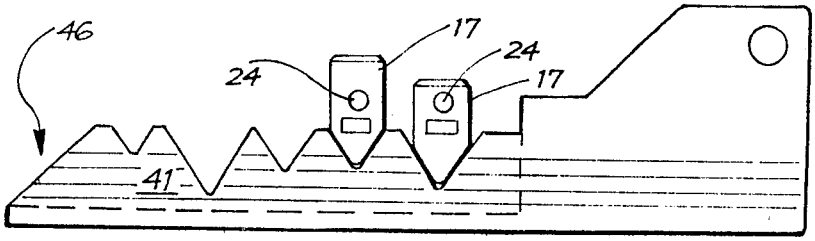
FIG. 4
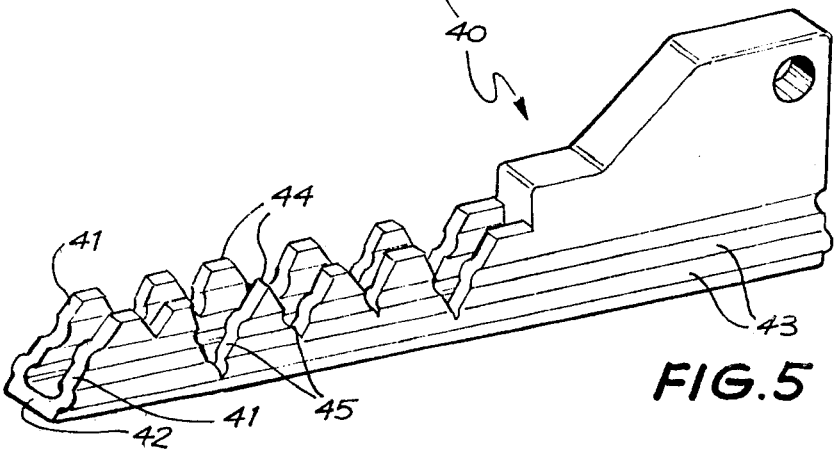
FIG. 5

CYLINDER LOCK

The present invention relates to cylinder locks and more particularly to barrels and keys therefor.

Known cylinder locks employing a conventional barrel require the use of upper pins which bear against the locking pin and bias same toward the keyway. Thus the barrel is not self contained which is a disadvantage. In particular the use of upper pins increases the size of the locks. Still further, most cylinder locks do not offer a large number of possible lock combinations which has the disadvantage that the locks are more easily picked while it limits the number of combinations available to users.

Where large combinations are available it has been found that these types of cylinder locks employ a large number of different parts and accordingly are generally expensive to manufacture due to their complexity.

It is still further desirable in locks generally that there be control over the key blanks and cut keys since it is a disadvantage of known locks that the keys are too easily reproduced thus greatly reducing the security of the lock.

It is an object of the present invention to overcome or substantially ameliorate the above disadvantages.

There is disclosed herein a barrel for a cylinder lock, said barrel comprising a generally cylindrical barrel body having end faces, a keyway formed in said barrel body and extending longitudinally inwardly from one end face, a plurality of guide bores formed in the barrel body and extending outwardly from said keyway so as to communicate therewith, a locking pin slidably received within each of said bores and retained therein so as to be movable from a position projecting into said keyway to a retracted position, said bores being grouped in two sets with the bores of each set being aligned longitudinally so that the two sets are arranged in a spaced generally parallel co-extensive relationship, and wherein said pins are prevented from rotation about the axes of the bores.

A preferred form of the present invention will now be described by way of example with reference to the accompanying drawings, wherein:

FIG. 3 is a schematic perspective view of a housing to receive the barrel of FIGS. 1 and 2;

FIG. 4 is a schematic side elevation of a key adapted to be used with the barrels of FIGS. 1 and 2 with the key engaged by locking pins;

FIG. 5 is a schematic perspective view of the key of FIG. 4;

Figure 1:
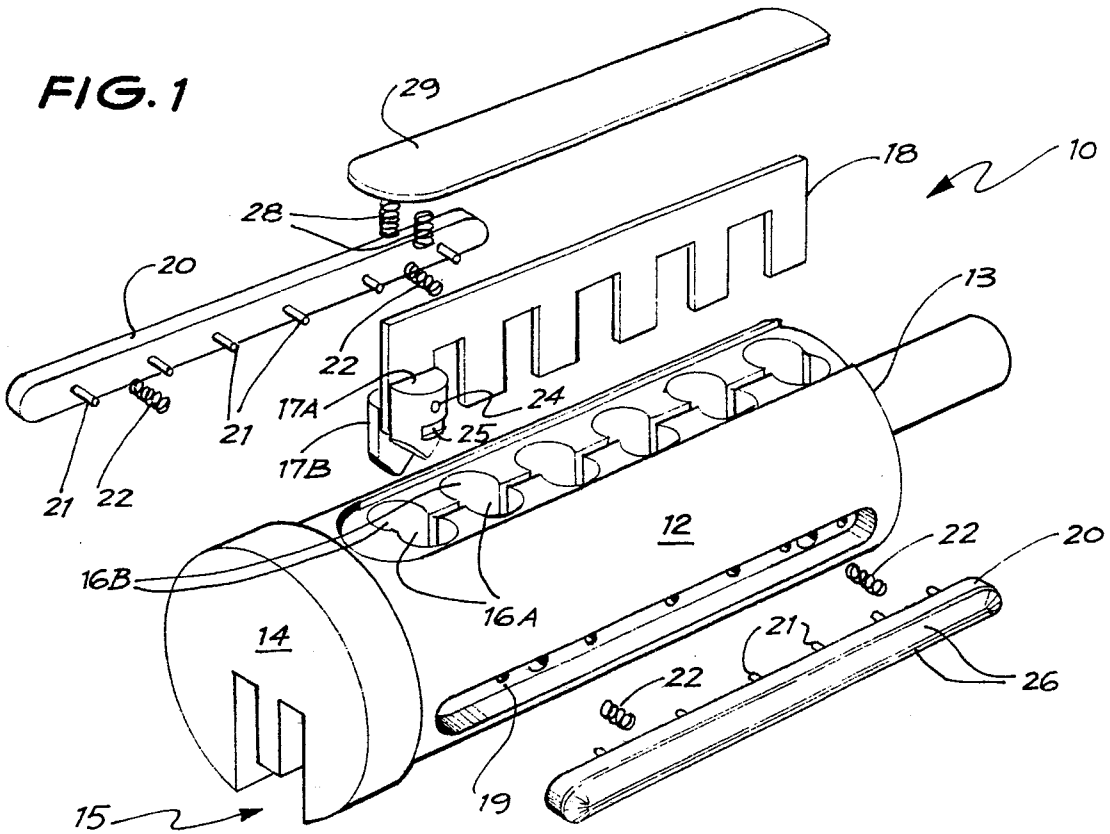
FIG. 1 is a schematic perspective parts exploded view of a barrel for a cylinder lock.

In FIG. 1 there is schematically depicted a barrel 10 of a cylinder lock, which barrel 10 is adapted to be located within the housing 11 of FIG. 3. The barrel 10 includes a generally cylindrical body 12 having end faces 13 and 14. Formed in the body 12 is a keyway 15 which extends longitudinally inwardly from the face 14 to adjacent the face 13. The keyway 15 has a configuration adapted to receive a key similar to that of FIGS. 4 and 5, however it may be altered to fit any one of the keys depicted in FIGS. 6 to 9.

Extending inwardly from the outer cylindrical periphery of the body 12 are a plurality of bores 16 which are divided into two longitudinally extending sets 16A and 16B. Additionally the bores 16 are arranged in pairs consisting of a bore from each set. Slidably received within each bore is a locking pin 17, which locking pins are divided into sets 17A and 17B. The locking pins 17A and 17B are held in a spaced parallel relationship by a plate 18 which in combination with the internal surfaces of the bores 16, restrict the locking pins 17 to moving in a direction generally perpendicular to the longitudinal axis of the body 12. Additionally each pin 17 has a flat face which slidably abuts the polate 18 so as to prevent rotation of the pins 17 about the longitudinal axes.

The body 12 is further provided with two longitudinally extending recesses 19 which are adapted to receive locking bars 20 which have locking projections 21. The locking bars 20 are biased to a radially outer position by means of springs 22. The locking bars 20 are slidably received within the recesses 19 so as to be movable from a radially inner position allowing rotation of the barrel 10 to a radially outer position engaged within the grooves 23 (Fig. 3) formed on the internal surfaces of the housing 11. In this radially outer position the barrel 10 is prevented from rotating by the locking bars 20.

Each of the pins 17 is provided with a recess 24 which is dimensioned to receive a locking projection 21 so that upon location of the recesses 24 in the correct position, the corresponding locking projection is engageable therein. Additionally each pin 17 may be provided with a dummy recess 25 which is provided to hinder picking of the lock.

Upon a key of correct configuration being inserted in the keyway 15, each of the pins 17 is located so that the locking projections 21 are receivable within the recess 24 thereby allowing the locking bars 20 to move to a radially inner position. Thus the barrel 10 may be rotated. If the recesses 24 are not all correctly aligned, then the locking bars are prevented from moving thus retaining the barrel 10 in a locking position. As can be seen from FIGS. 1 and 3, the locking bars 20 are provided with converging surfaces 26 which cooperate with converging surfaces 27 forming the groove 23 to force the locking bars 20 radially inwardly. The locking pins 17 are biased to a position projecting inwardly of the keyway 15 by means of springs 28 which bear against the locking pins 17 and a cover plate 29.

Figure 2:
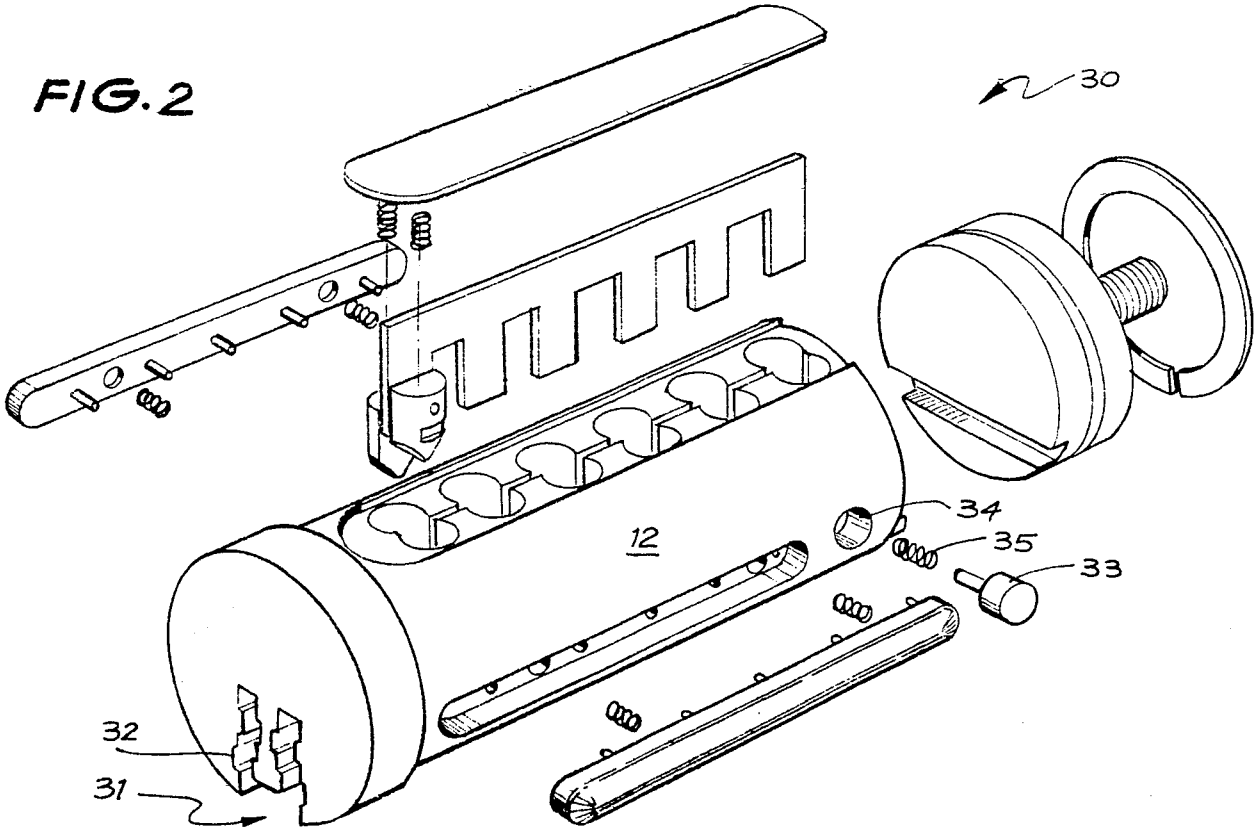
FIG. 2 is a schematic parts exploded view of a further barrel to that of FIG. 1.
Figure 6:
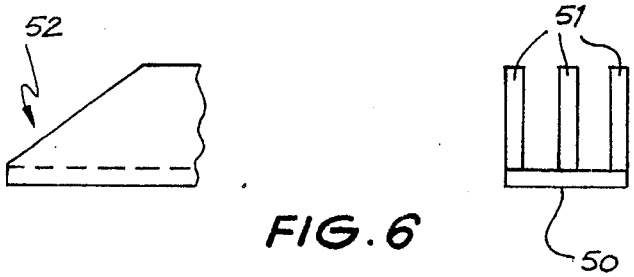
FIGS. 6, 7 and 8 are schematic end elevations and side elevations of various key blanks which may be employed with the barrels of FIGS. 1 and 2.

Turning now to FIG. 2 wherein there is schematically depicted a barrel 30 which is of very similar construction to the barrel 10 of FIG. 1. The difference being that the barrel 30 has a keyway 31 provided with longitudinally extending flutes 32 which again increases the number of combinations available for the lock. Additionally there is provided further pins 33 which are adapted to engage an annular groove formed on the internal surfaces of the housing 11. These further pins 33 are adapted to retain the barrel 30 within the housing 11 until a key of correct combination is inserted allowing retraction of these further pins 33. The pins 33 are slidably received within passages 34 formed in the body 12 with a spring 35 being provided to bias the pins 33 to their radially outer position retaining the barrel 30 within the housing 11. The pins 33 are moved radially inwardly by co-operating cam surfaces on an internal surface on a surrounding housing. More particularly the housing 11 of FIG. 3 could be provided with the co-operating cam surfaces if so required.

It should be appreciated that the barrels of FIGS. 1 and 2 could have key slots having two or more key blades. In such cases the number of rows of locking pins would be increased.

Turning now to FIGS. 4 to 10, and particularly FIGS. 4 and 5, there is schematically depicted a key 40 of generally U-shaped transverse cross section so as to have upwardly extending key blades 41 joined by a base 42. There is schematically illustrated in FIG. 4 two locking pins 17 engaged with the teeth of the blades 41 so that the passages 24 are aligned thus allowing entry of the locking projections 21. The key 40 is also provided with longitudinally extending flutes and ridges 43 adapted to increase the number of combinations available to the lock. It should be particularly appreciated that the teeth 44 formed in the blades 41 are separated by valleys 45 which may extend downwardly to a limit position adjacent the base 42. By providing the key 40 with blades 41 joined by base 42, the volleys may extend to adjacent the base 42 without the key 40 being weakened to an extent such that it is easily deformed during use.

A particular feature provided in the key 40 is the leading portion 46 which is substantially of a chisel configuration enabling the barrel 10 to be self contained in that outer locking pins are not required. By providing the key 40 with the leading portion 46, the locking pins 17 may extend further into the keyway 15.

A further advantage of the key 40 in that the valleys 45 are more easily formed since the blades 41 are in a spaced parallel relationship.

Figure 7:
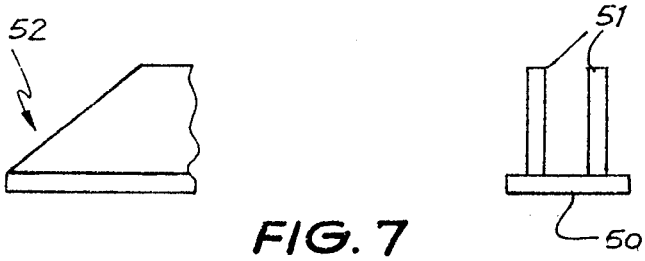
Figure 8:
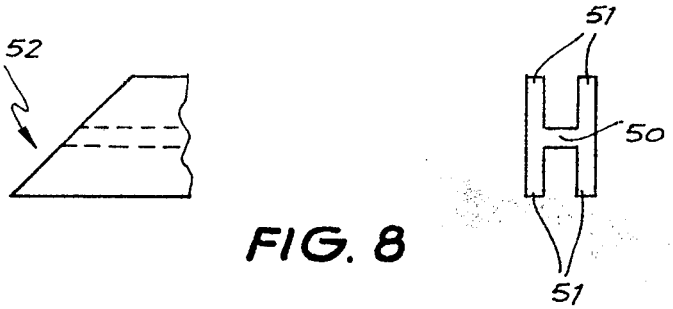

Turning now to FIGS. 7 and 8, there is schematically depicted a plurality of key configurations with each key including a base 50 from which extend one or more key blades 51 adapted to receive a key profile. In each instance the keys of FIGS. 6 to 10 are adapted such that valleys formed in the blades 51 may extend to adjacent the base 50 without structurally weakening the key to an extent that it is easily damaged during normal use. Still further in each case the keys are provided with a leading portion 52 of a chiselled configuration.

By providing two or more blades 51, the number of possible combinations is increased. Accordingly, a barrel adapted to receive the key of FIG. 6 would be provided with an additional set of locking pins and bores.

Figure 9:
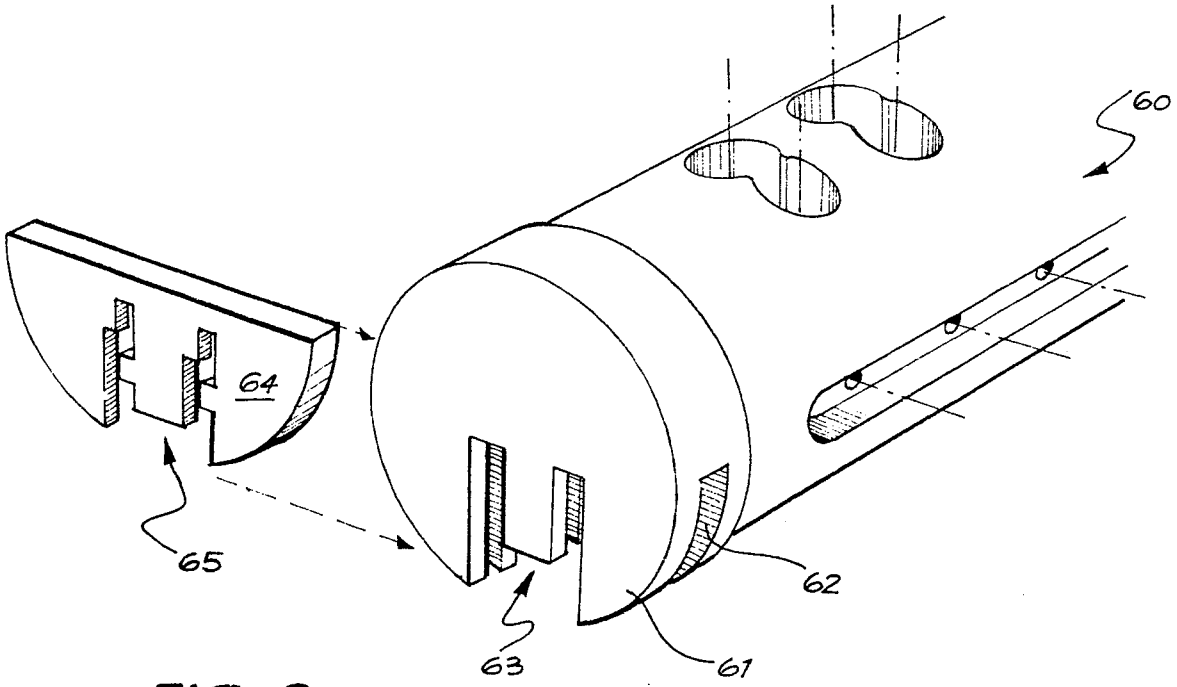
FIG.9 is a schematic perspective view of a barrel and front portion of a cylindrical lock.

Turning now to FIG. 9, there is schematically depicted the barrel 60 of a cylindrical lock. The barrel 60 has a front face 61 which defines a key slot 63. The key slot 63 is shaped so as to accommodate a wide range of key configurations of the type suitable for the barrel 60. The front face 61 is further provided with a transversely extending slot which is adapted to receive a key selection member 64 which has a key slot 65 which is aligned with the slot 63 when the member 64 is located within the slot 62. By providing an assembly member 64, a standard barrel 60 may be provided with individual key combinations being selected by interchangeable key selection members 65.

Figure 10:
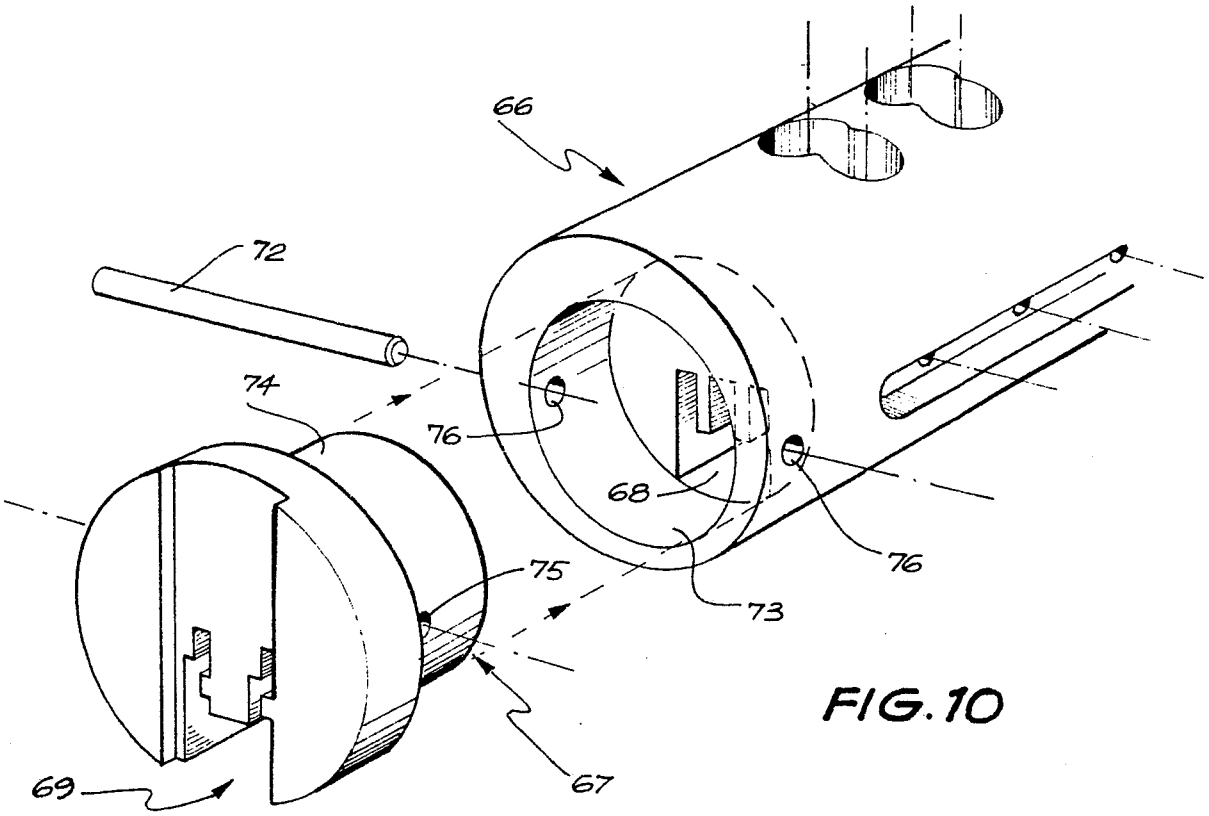
FIG. 10 is a schematic perspective view of a further barrel and front portion of a cylindrical lock.
Figure 11:
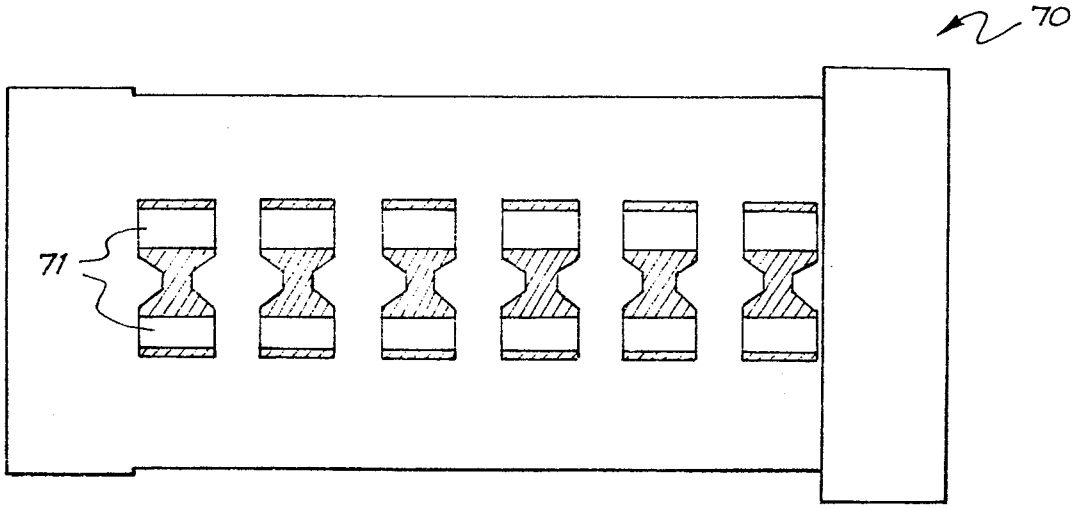
FIG. 11 is a schematic plan view of a still further barrel body of a cylindrical lock.

Turning now to FIG. 10, the barrel 66 is similar to that of FIG. 11 in that it is provided with a removable front portion 67. Further, the barrel 66 is provided with a key slot 68 adapted to receive a large variety of key configurations which are suitable to be used with the barrel 60. Additionally, the barrel 60 is provided with a central cylindrical aperture 73 adapted to receive a cylindrical projection 74 forming part of the front portion 67. Additionally, there is provided a passage 75 extending through the cylindrical projection 74 which is aligned with passages 76 formed in the barrel 66 to allow the insertion of a pin 72 to retain the front portion 67 in its operative position.

The front portion 67 has a key slot 69 which is adapted to select a particular key configuration. Accordingly the barrel 66 is adapted to be used as a standard barrel with particular key configurations being selected by the front portion 67.

In FIG. 11 the body 70 is of similar configuration to the previously described barrel bodies, however the bores 71 which receive locking pins are square in transverse cross-section. The locking pins would be of a complementary cross-section so as to interact with the bores 71 to prevent rotation of the locking pins within the bores 71.

Figure 12:
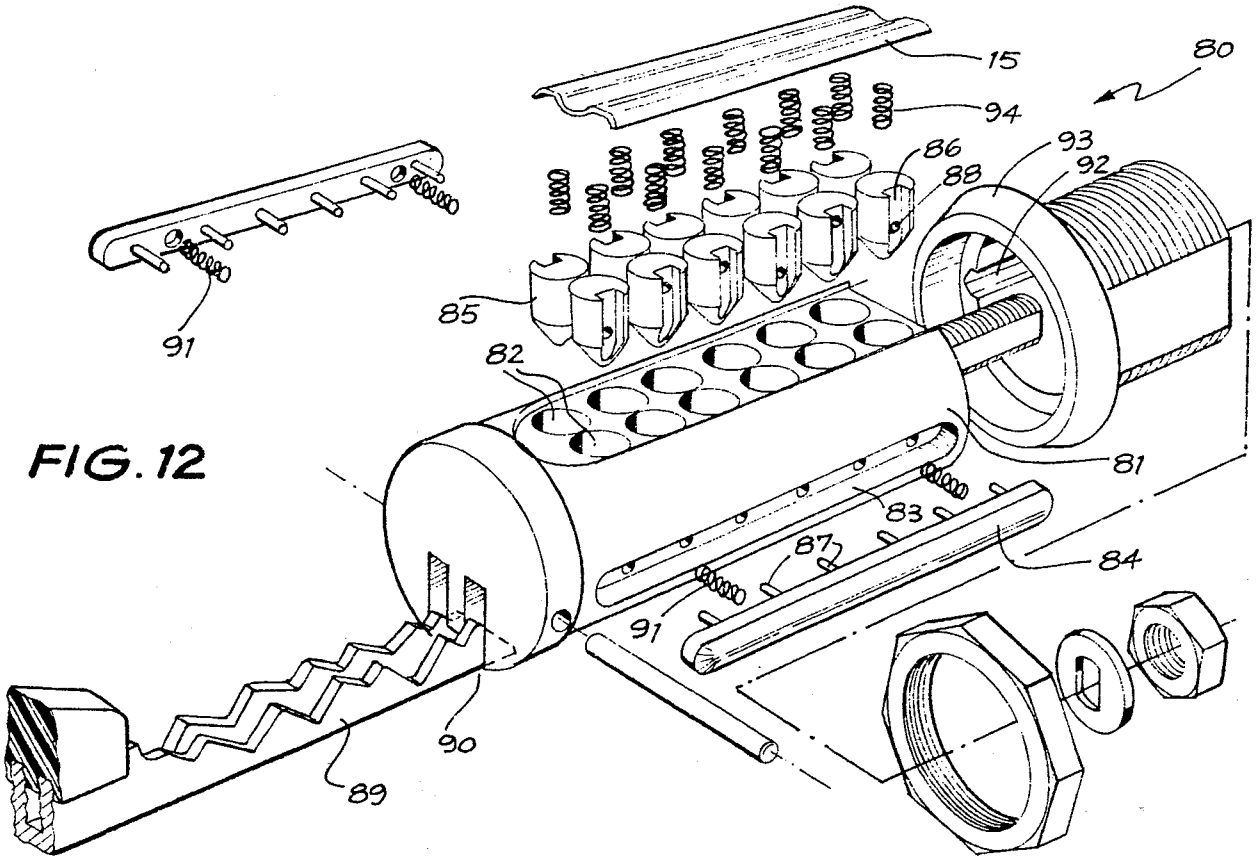
FIG. 12 is a parts exploded schematic perspective view of a further lock barrel.
Figure 14:
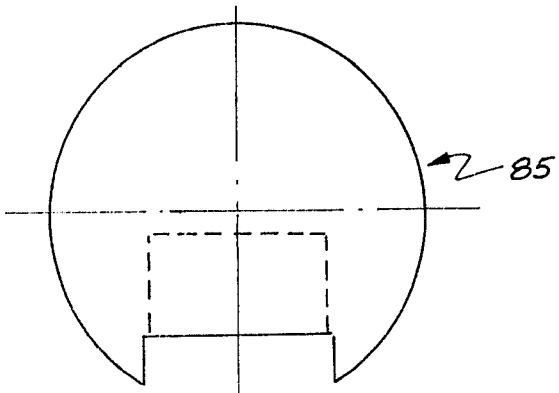
FIG. 14 is a plan view of the pin of FIG. 13.
Figure 13:
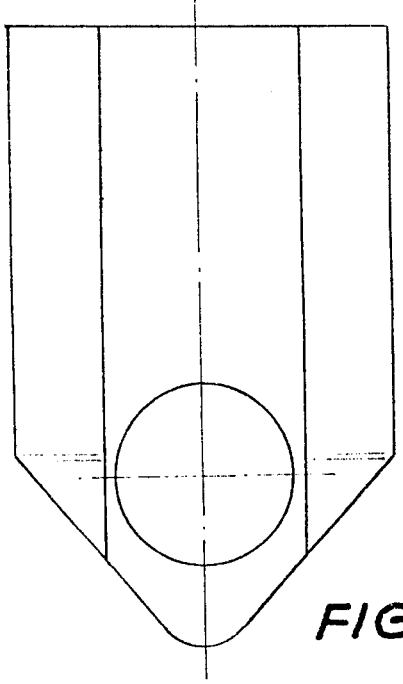
FIG. 13 is a side elevation of a locking pin used in the barrel of FIG. 12.

Now in regard to FIG. 12 wherein there is depicted a cylinder lock barrel 80 in a parts exploded view, it can be seen that the barrel 80 includes a body 81. The body 81 has two rows of cylindrical holes 82 which are transversely aligned so as to be arranged in pairs. There is also formed in the body 81*a* slot 83 which is adapted to slidingly receive side bars 84. The holes 82 are adapted to slidingly receive locking pins 85 which are each provided with a slot 86 which slidingly receives the projections 87 on the side bars 84. Additionally each locking pin 85 has a hole 88 which also receive the projections 87. In FIG. 14 one of the locking pins 85 is illustrated.

In operation of the above barrel, the pins 85 are biased to engage the tooth profile of the key 89 when it is engaged within the key slot 90. The pins 85 are biased to engage the key 89 by means of springs 94. The springs 94 abut a cover plate 95 which is slidingly received within a slot formed in the body 81. Accordingly the holes 82 are in communication with the key slot 90. If the key 87 has the correct profile, then the holes 88 will line up along the side bars 84 to move radially inwardly of the body 81 to allow the cylinder barrel to rotate.

It should be appreciated that the pins 85 are prevented from rotation about their longitudinal axes by the sliding engagement of the projections 87 within the slots 86. Additionally the side bars are located within a slot 92 formed in the housing 93 of the lock. Accordingly the side bars 84 prevent the rotation of the cylinder barrel until the holes 88 are longitudinally aligned to enable the side bars 84 to move radially inwardly.

Figure 15:
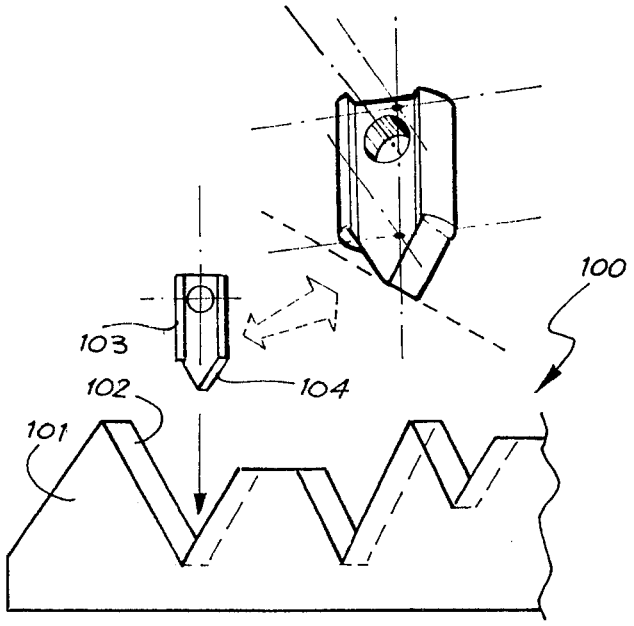
FIG. 15 is a schematic side elevation of a key and locking pin.
Figure 16:
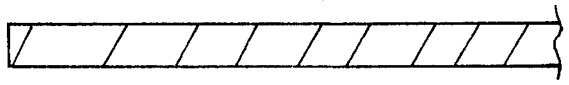
FIG. 16 is a plan view of the key of FIG. 15.

Turning now to FIGS. 15 and 16 wherein there is schematically depicted a single blade 100 which may form one of the blades of the keys described previously. The blade 100 has teeth 101 with key surfaces 102 which are inclined both to the longitudinal axis of the key as well as the general plane of the key. Accordingly each key surface 102 would define a plane which intersects the general plane of the blade 100. Accordingly to minimise wear and to enable easy operation of the lock to be employed with the blade 100 the locking pins 103 would have a correspondingly angled key surface engaging the portion 104. With the above described key blade 100, the combinations available with the previously described keys is further expanded as the angles of the key surface 102 may be altered to thereby alter the combination of the lock which would suit the key blade 100.

What I claim is:

1. A barrel for a cylinder lock, said barrel comprising a generally cylindrical barrel body having end faces, a keyway formed in said barrel body and extending longitudinally inwardly from one end face, a plurality of guide bores formed in the barrel body and extending outwardly from said keyway so as to communicate therewith, a single lock pin slidably received within each said bores and retained therein so as to be movable longitudinally thereof from a position projecting into said keyway to a retracted position, with each pin being prevented from rotation about the longitudinal axis of the bore, said bores being grouped in two sets with the bores of each set being aligned longitudinally so that the two sets are ranged in a space generally parallel coextensive relationship, two side bar slots formed in opposite sides of the body so as to extend longitudinally thereof, said body further having a passage extending from each bore so that the passages are arranged in two sets with each set of passages terminating at a particular side bar slot, the recesses of each pin being selectively alignable with the passage extending from the bore of the respective pin, and wherein said barrel further includes a side bar slidably located in each slot so as to be movable from a radially outer locking position to a radially inner release position, and each said side bar has a plurality of projections which are located in said passages and extend therethrough so as to be selectively locatable within the recesses of the pins to enable movement of the side bars to said release position.

2. The barrel of claim 1 wherein the guide bores are arranged in pairs with one bore from each set, and with the bores of each set being transversely adjacent.

3. The barrel of claim 1 wherein said pins are resiliently biased towards said keyway and said side bars are resiliently biased to said radially outer position.

4. The barrel of claim 3 wherein each pin is provided with a longitudinal groove within which the projections of the side bars are slidably received so as to prevent rotation of the pins and each pin passage extends from its respective groove.

5. The barrel of claim 1 further including a key selection member movably attached to said one end face, said key selection member having a key slot aligned with said keyway.

6. The barrel of claim 3 wherein said bores are generally cylindrical.

7. The barrel of claim 6 wherein each pin has a tapered end portion which abuts a key profile where a key is located within said keyway, each tapered portion includes converging generally planar faces.

8. The barrel of claim 7 wherein at least one of said faces is inclined to a said first plane passing through the longitudinal axis of one set of pins while being inclined to a further plane which is normal to the first plane and the longitudinal axis of the body.

9. A barrel of a cylinder lock, said barrel comprising a body of generally cylindrical configuration so as to have end faces joined by a side surface, a keyway in said body extending longitudinally inwardly from one end face, a plurality of guide bores extending from said keyway to said side surface, a locking pin slidably received wity each bore, means restraining the locking pins from rotating about the axis of the bores and wherein the locking pins have key tooth engaging surfaces which are inclined to both a first plane defined by the key blade and by a second plane normal to the first plane.

* * * * *